United States Patent [19]

Sakurai et al.

[11] 4,151,716

[45] May 1, 1979

[54] EXHAUST MANIFOLD SYSTEM FOR INTERNAL COMBUSTION ENGINE

[75] Inventors: Yoshitoshi Sakurai; Takashi Umemoto, both of Niiza, Japan

[73] Assignee: Honda Giken Kogyo Kabushiki Kaisha, Tokyo, Japan

[21] Appl. No.: 800,728

[22] Filed: May 26, 1977

[30] Foreign Application Priority Data

Jun. 5, 1976 [JP] Japan ..... 51-65145
Jul. 6, 1976 [JP] Japan ..... 51-79437

[51] Int. Cl.[2] ..... F01N 3/10
[52] U.S. Cl. ..... 60/282; 60/323
[58] Field of Search ..... 60/282, 322, 323, 302

[56] References Cited

U.S. PATENT DOCUMENTS 4,028,887 6/1977 Tsutsumi ..... 60/282
4,067,192 1/1978 Yamazaki ..... 60/323

*Primary Examiner*—Douglas Hart

*Attorney, Agent, or Firm*—Lyon & Lyon

[57] ABSTRACT

An exhaust system for a multi-cylinder internal combustion engine employs exhaust port liners each connected to a pair of adjacent exhaust ports and having a single discharge opening. An intake passage leads from each discharge opening to an auxiliary reaction chamber. Each intake passage may communicate with the same auiliary reaction chamber, or separate auxiliary reaction chambers may be provided for each intake passage. In either case, a main reaction chamber surrounds and encloses the auxiliary reaction chamber(s), and an outer chamber surrounds and encloses the main reaction chamber. Each auxiliary reaction chamber discharges into the main reaction chamber through an opening, and a misaligned opening connects the main reaction chamber to the outer chamber. If two auxiliary reaction chambers are employed, their openings are placed so that the streams of exhaust gases passing through them intersect within the main reaction chamber.

5 Claims, 4 Drawing Figures

EXHAUST MANIFOLD SYSTEM FOR INTERNAL COMBUSTION ENGINE

This invention relates to internal combustion piston engines which operate on a lean air-fuel mixture and is particularly directed to an improved exhaust system for minimizing discharge of unburned hydrocarbons (HC) and carbon monoxide (CO) into the atmosphere. In general, this is accomplished by maintaining the temperature of the exhaust gases at a sufficiently high level and for sufficient residence time to continue the oxidation of HC and to oxidize CO into $C_2$.

In accordance with this invention, the valved exhaust ports of the engine are provided with liners each of which communicates with two adjacent exhaust ports of different valve timing, each linear having only a single discharge opening. A plurality of intake passages are provided in the exhaust manifold, each intake passage receiving exhaust gases from one of the liner discharge openings, respectively. One or more generally spherical auxiliary reaction chambers receive exhaust gases from the intake passages. In one form of this invention, the intake passages all communicate with a single auxiliary reaction chamber, and in another form of the invention each intake passage communicates with a separate auxiliary reaction chamber. The auxiliary reaction chamber or chambers are surrounded and enclosed by a main reaction chamber which in turn is surrounded and enclosed by an outer chamber. The main reaction chamber also encloses at least a portion of the intake passages leading to the auxiliary reaction chamber or chambers. Openings are provided for conducting exhaust gases from the auxiliary exhaust reaction chamber or chambers into the main exhaust reaction chamber, and from the main exhaust reaction chamber into the outer chamber. This construction minimizes reduction in temperature and promotes the oxidation reactions of HC and CO.

In the form of the invention where a pair of auxiliary reaction chambers are separately fed from separate intake passages, the openings from the auxiliary reaction chambers are positioned so that the streams of exhaust gases which pass therethrough intersect in the main reaction chamber to cause thorough mixing, but without excessive backpressure.

Other and more detailed objects and advantages will appear hereinafter.

Figure 1:
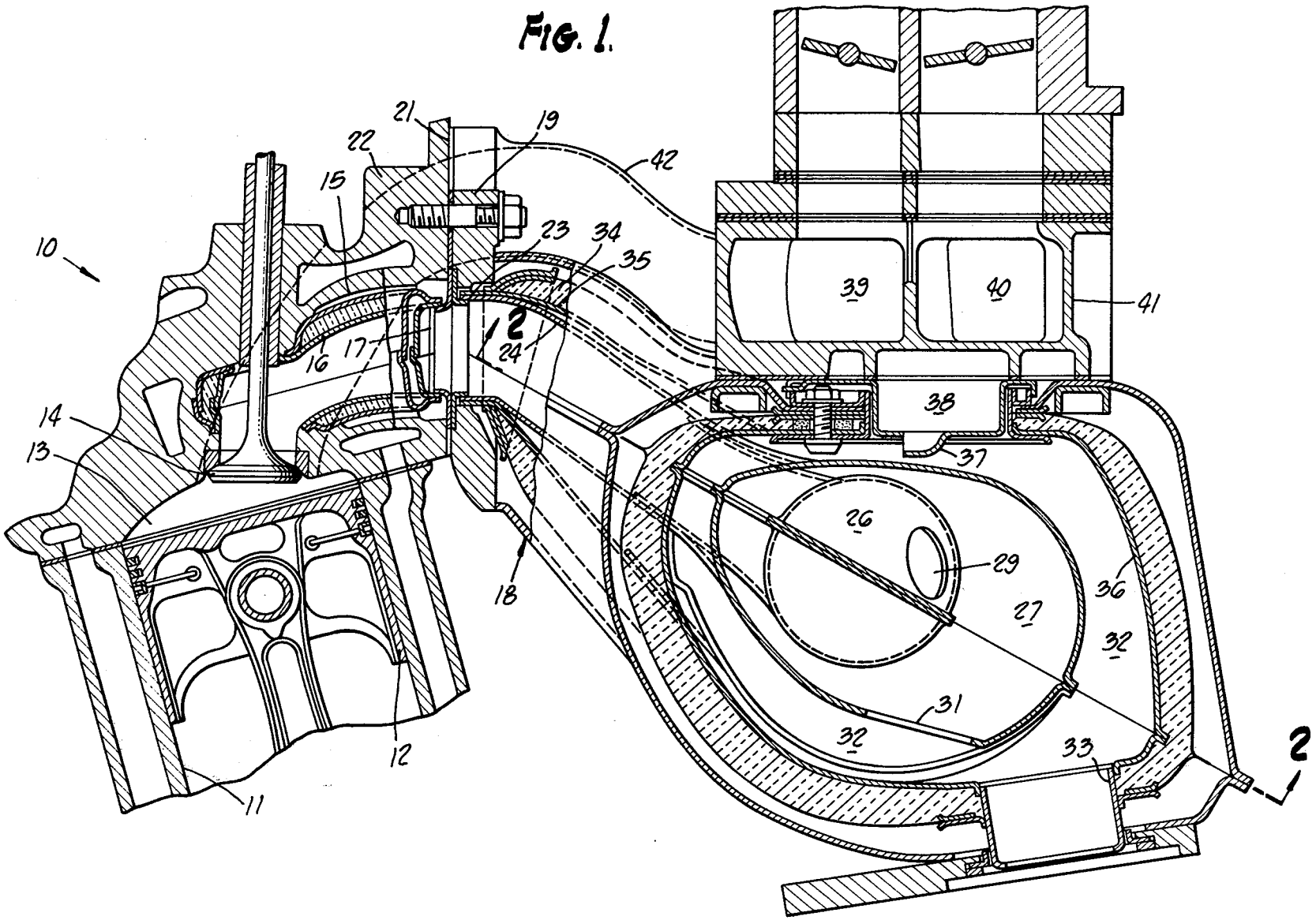
FIG. 1 is a sectional side elevation showing a preferred embodiment of this invention.

Referring to the drawings, the internal combustion engine generally designated 10 has a plurality of cylinders 11 each provided with a reciprocating piston 12. Each piston 12 forms one wall of a combustion chamber 13, and each combustion chamber is provided with an exhaust valve 14. An exhaust port 15 downstream from each exhaust valve 14 contains a portion of a liner 16. Each liner 16 communicates with two adjacent exhaust ports 15 and is provided with a single discharge opening 17.

Exhaust gases discharged from the liner openings are received into the exhaust manifold generally designated 18. A flange 19 on the manifold is bolted against the face 21 of the cylinder head 22. The discharge openings 17 each communicate with an aligned intake opening 23 in an induction pipe 24. Each induction pipe 24 leads to a generally spherical auxiliary reaction chamber 25, 26, which are separate and do not directly communicate with each other.

Figure 2:
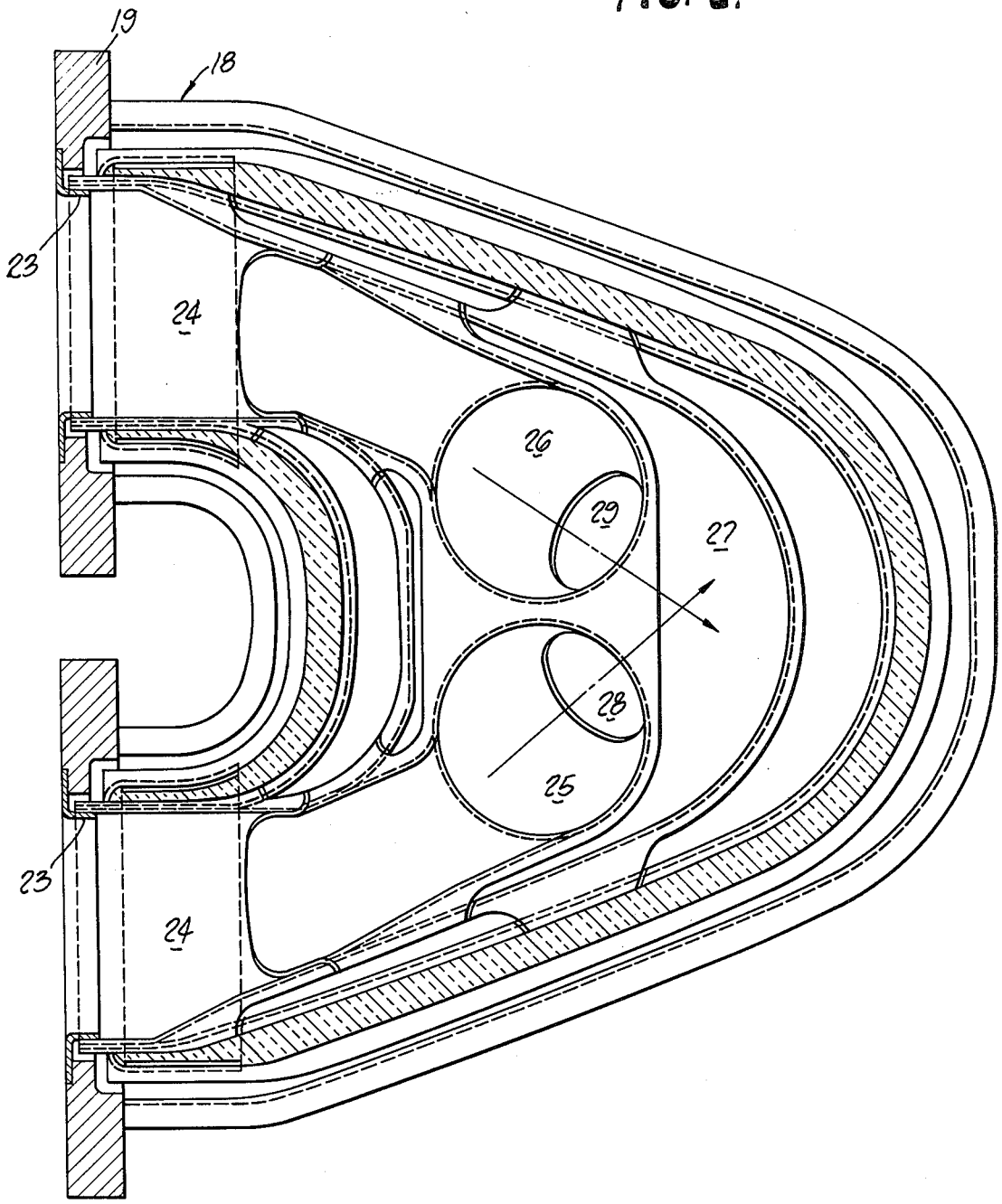
FIG. 2 is a bottom plan view partly in section, taken along the lines 2—2 as shown in FIG. 1.

These auxiliary reaction chambers 25 and 26 are enclosed within a relatively large main reaction chamber 27. An opening 28 is formed in a wall of the auxiliary reaction chamber 25, and in similar fashion an opening 29 is formed in the wall of the auxiliary reaction chamber 26. The openings 28 and 29 are so placed that their respective axes intersect at a point located in the main reaction chamber 27, as shown in FIG. 2. A single opening 31 is formed in the wall of the main reaction chamber 27 and is placed symmetrically between and below the openings 28 and 29. Exhaust gases pass from the main reaction chamber 27 into the insulated chamber 32 which surrounds it. Exhaust gases leave the exhaust manifold 18 through the discharge pipe 33.

In operation, the alternate pulses of exhaust gas which pass through the liners 16 as the exhaust valves 14 open and close are maintained at high temperature, the insulated liners 16 serving to minimize heat loss to the water-cooled cylinder head 22. The temperature of the exhaust gases passing into the intake openings 23 and induction pipes 24 is maintaind as high as possible by the insulated double wall construction provided by the insulation 34 surrounding the wall 35 which in turn encloses the walls of the induction pipes 24. The walls 35 which surround the induction pipes 24 join with and constitute a part of the insulated walls 36 which form the insulated chamber 32. The volumes of the auxiliary reaction chambers 25 and 26 are small in comparison to the volume of the main reaction chamber 27. Preferably the total volume of the chambers 25 and 26 is less than one-half of the volume of the main reaction chamber 27. The temperature of the exhaust gases is maintained at a high level by reason of the oxidation of unburned hydrocarbons and oxidation of CO to $CO_2$ within the exhaust reaction chambers.

The positions of the openings 28 and 29 are selected so that the streams of exhaust gases passing through them intersect in the main reaction chamber 27, as shown by the arrows in FIG. 2. The placing of the openings 28 and 29 to cause the exhaust gas streams to intersect produces thorough mixing without resulting in an objectionable increase in backpressure that develops in conventional systems where the hot gas outlets open against each other. The auxiliary reaction chambers 25 and 26 provide good exhaust purification particularly during low load operation of the engine.

Exhaust gases within the outer insulated chamber 32 can be deflected by barrier 37 into a chamber 38 to heat intake air-fuel mixtures in the chambers 39 and 40 of the riser 41 for the intake manifold 42.

Figure 3:
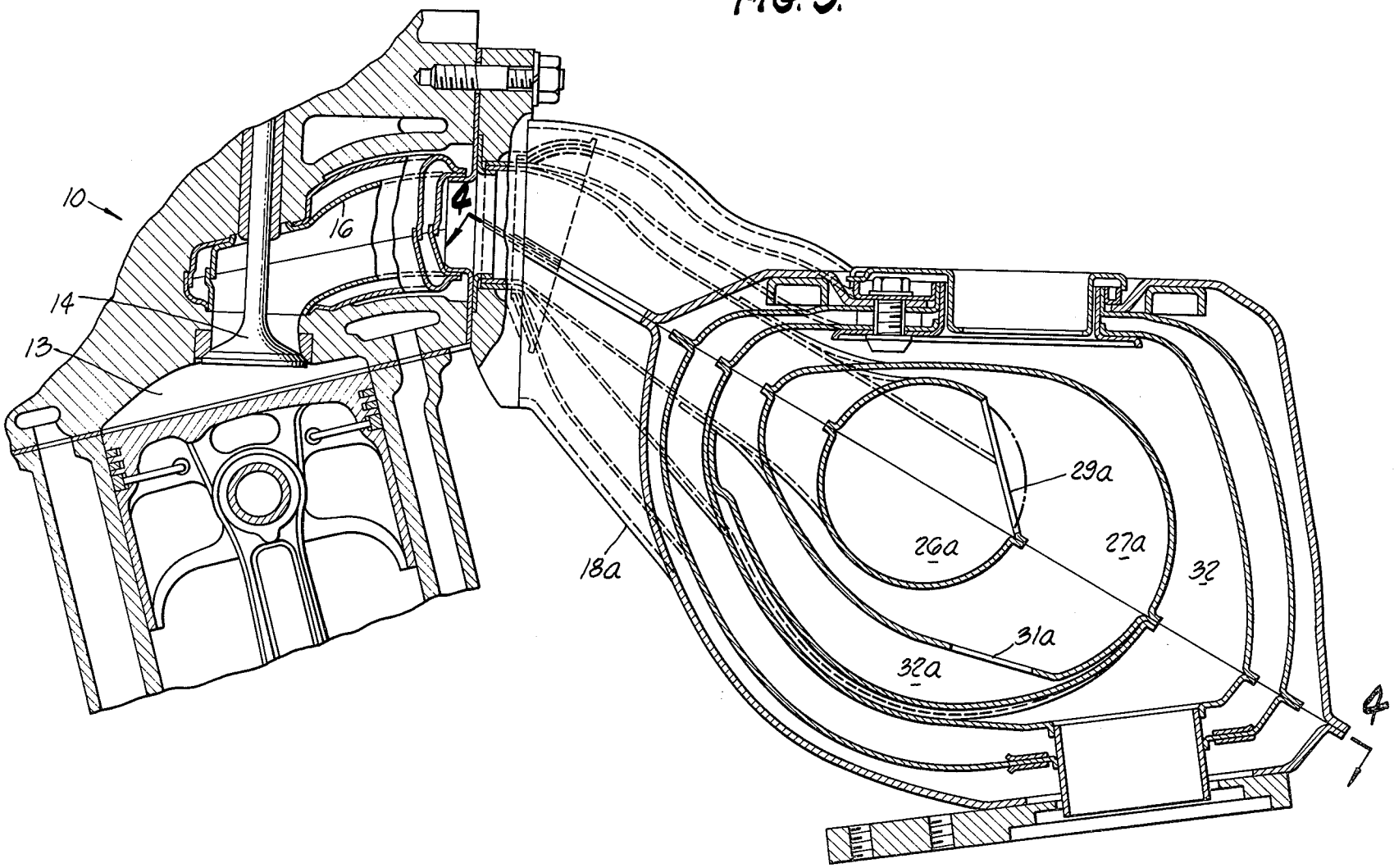
FIG. 3 is a sectional side elevation showing a modification.
Figure 4:
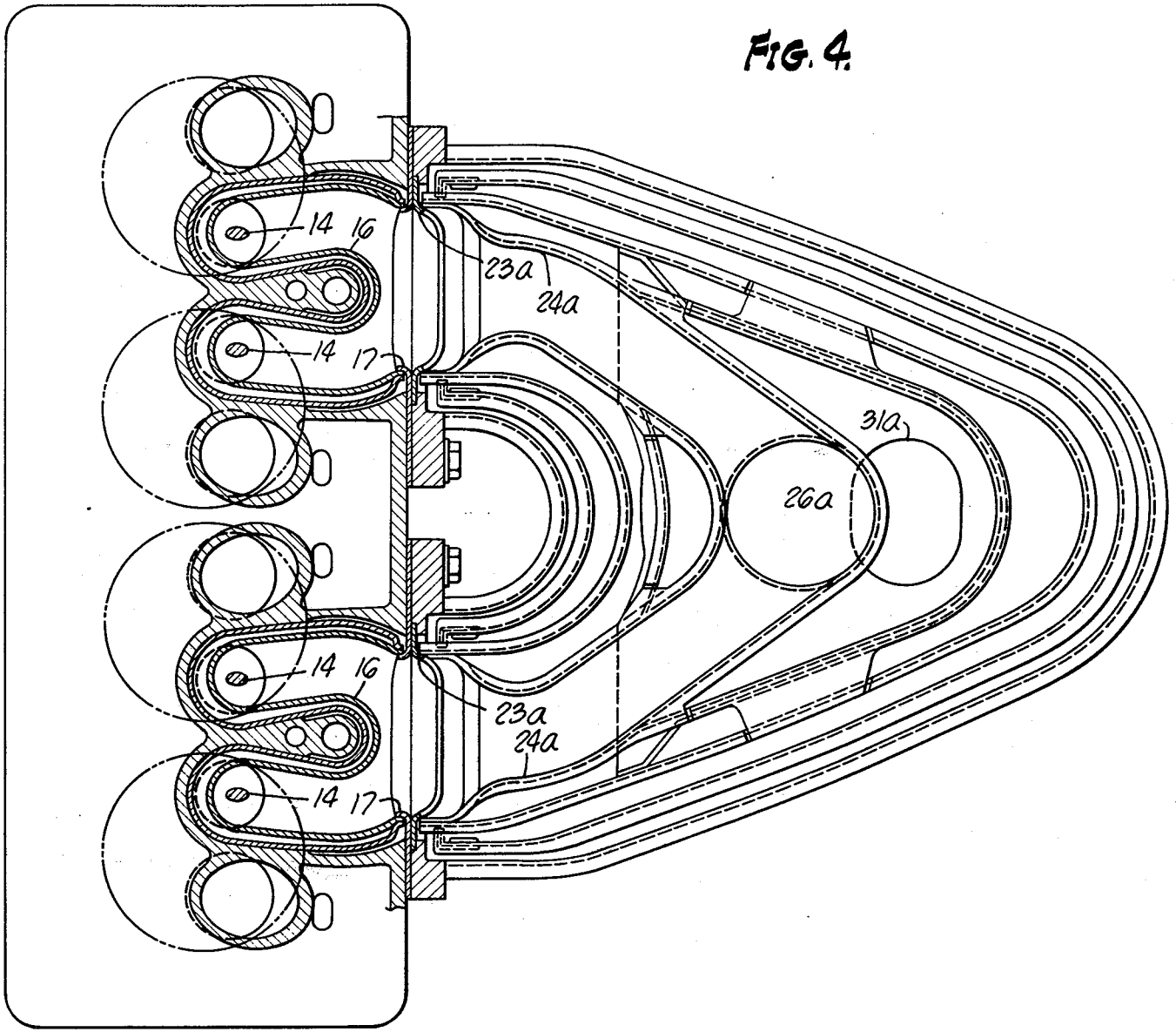
FIG. 4 is a top plan view partly in section, taken along the lines 4—4 as shown in FIG. 3.

In the modified form of the invention shown in FIGS. 3 and 4, the engine 10 with combustion chambers 13, exhaust valves 14, exhaust port liners 16, etc., are the same as that previously described. The exhaust manifold assembly **18*a*, however, differs from that previously described in that only one auxiliary exhaust chamber 26*a* is employed. The single discharge opening 17 from each dual liner 16 communicates with the aligned intake opening 23*a*, leading to induction pipes 24*a*. Both induction pipes 24***a* communicate with the single auxiliary reaction chamber 26*a*. The opening 29*a* in the upper portion of the auxiliary exhaust chamber 26*a* causes hot exhaust gases to pass into the main reaction chamber 27*a* and then through opening 31*a* into the enclosing chamber 32*a*. Thus, the auxiliary reaction chamber 26*a* is surrounded and enclosed by the main reaction chamber 27*a*, which in turn is surrounded and enclosed by the outer chamber 32*a*. In other respects, the modified form of the invention shown in FIGS. 3 and 4 is similar to that previously described.

Having fully described our invention, it is to be understood that we are not to be limited to the details herein set forth but that our invention is of the full scope of the appended claims.

We claim:

1. In an exhaust system for an internal combustion engine having a plurality of cylinders, the combination of: a valved exhaust port for each of said cylinders, a plurality of exhaust port liners each connected to a pair of adjacent exhaust ports and having a single discharge opening, means forming a plurality of intake passages each receiving exhaust gases from one of the liner intake openings, respectively, said discharge passages communicating with at least one generally spherical auxiliary reaction chamber, a main reaction chamber surrounding and enclosing the auxiliary reaction chamber and at least a portion of said intake passages, a first opening from the auxiliary reaction chamber to the main reaction chamber, an outer chamber surrounding and enclosing said main reaction chamber, and a second opening from the main reaction chamber to the outer chamber, said second opening being misaligned with respect to said first opening.

2. In an exhaust system for an internal combustion engine having a plurality of cylinders, the combination of: a valved exhaust port for each of said cylinders, a plurality of exhaust port liners each connected to a pair of adjacent exhaust ports and having a single discharge opening, means forming a plurality of intake passages each receiving exhaust gases from one of the liner discharge openings, respectively, said intake passages communicating with a single generally spherical auxiliary reaction chamber, a main reaction chamber surrounding and enclosing said auxiliary reaction chamber and at least a portion of said intake passages, a first opening from said auxiliary reaction chamber to said main reaction chamber, an outer chamber surrounding and enclosing said main reaction chamber, and a second opening from said main reaction chamber to said outer chamber, said second opening being misaligned with respect to said first opening.

3. The combination set forth in claim 2 in which the total volume of the auxiliary reaction chamber is less than one-half of the volume of the main reaction chamber.

4. In an exhaust system for a four cylinder internal combustion engine, the combination of: a valved exhaust port for each of said cylinders, a plurality of exhaust port liners each connected to a pair of adjacent exhaust ports and each having a single discharge opening, means forming a pair of intake passages each receiving exhaust gases from one of the liner discharge openings, respectively, two generally spherical auxiliary reaction chambers, each intake passage communicating with only one of said auxiliary reaction chambers, a main reaction chamber surrounding and enclosing both auxiliary reaction chambers and a portion of said intake passages, an opening from each auxiliary reaction chamber to the main reaction chamber, said openings being positioned to cause streams of exhaust gases passing therethrough to intersect in said main reaction chamber, an outer chamber surrounding and enclosing said main reaction chamber, and another opening from the main reaction chamber to the outer chamber, the latter said opening being misaligned with respect to the first said openings.

5. The combination set forth in claim 4 in which the total volume of the auxiliary reaction chambers is less than one-half of the volume of the main reaction chamber.

* * * * *

UNITED STATES PATENT AND TRADEMARK OFFICE

CERTIFICATE OF CORRECTION

PATENT NO. : 4,151,716

DATED : May 1, 1979

INVENTOR(S) : Yoshitoshi Sakurai et al

It is certified that error appears in the above-identified patent and that said Letters Patent are hereby corrected as shown below:

Column 1, line 13, "$C_2$" should read --$CO_2$--.

Column 2, line 30, correct spelling of "maintained".

Column 3, line 23, "intake" at end of line should read --discharge--.

Column 3, line 24, "discharge" should read --intake--.

Column 4, line 13, "chamber" should read --chambers--.

Signed and Sealed this

*Fourteenth* Day of *August 1979*

[SEAL]

*Attest:*

*Attesting Officer*

LUTRELLE F. PARKER

*Acting Commissioner of Patents and Trademarks*